US007419404B1

(12) United States Patent
Cai et al.

(10) Patent No.: US 7,419,404 B1
(45) Date of Patent: Sep. 2, 2008

(54) HIGH SPEED SIGNAL BACKPLANE INTERFACE

(75) Inventors: Xingjian Cai, Gilbert, AZ (US); Ke Wang, Laveen, AZ (US); Michael Castillo, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/728,017

(22) Filed: Mar. 23, 2007

(51) Int. Cl.
*H01R 13/648* (2006.01)

(52) U.S. Cl. ..... 439/608

(58) Field of Classification Search ..... 439/608, 439/108, 101, 701, 717, 862, 63, 79
See application file for complete search history.

(56) References Cited

U.S. PATENT DOCUMENTS

| | | | | |
|---|---|---|---|---|
| 6,227,882 | B1 * | 5/2001 | Ortega et al. | 439/101 |
| 6,565,387 | B2 * | 5/2003 | Cohen | 439/608 |
| 6,910,922 | B2 * | 6/2005 | Haga | 439/608 |
| 7,019,984 | B2 * | 3/2006 | Driscoll et al. | 361/788 |

* cited by examiner

*Primary Examiner*—Alexander Gilman
(74) *Attorney, Agent, or Firm*—Trop, Pruner & Hu, P.C.

(57) ABSTRACT

A modular chassis-based system may include a high speed backplane and multiple line cards. A connector connects the backplane to each line card for greater performance. The connector may include a stripline with a curved portion that transitions from the line cards to the backplane.

9 Claims, 2 Drawing Sheets

HIGH SPEED SIGNAL BACKPLANE INTERFACE

BACKGROUND

This relates generally to high speed signal backplane interfaces.

High speed signal backplane interfaces may be used as part of a modular chassis-based system including a high speed backplane and multiple line cards. Backplane interface solutions are also known as high speed serial links and they provide full duplex communication across the high speed backplane. Data may be transmitted across a high speed differential signal that is routed across the line card, through the connector and backplane, and across another set of high density connectors.

Backplanes may be used to connect boards, including telecom switches, multi-service provisioning platforms, add/drop multiplexers, digital cross connects, storage switches, routers, embedded platforms, multiprocessor systems, and blade servers. Modularity may be possible through the addition of line cards, switch cards, and services blades, all coupled to a single high speed backplane. Operating rates of greater than one gigabit per second are typically used.

At high data rates, the connector in the interface becomes critical to the interface performance. The connector connects the backplanes to the line cards. Electrical field distortion and radiation loss of standard interface connectors may degrade the interface performance. In fact, the interface connector can cause the interface to fail even after applying advanced signaling techniques, such as de-emphasis in the transmitter buffer and equalization in the receiver buffer.

DETAILED DESCRIPTION

Figure 1:
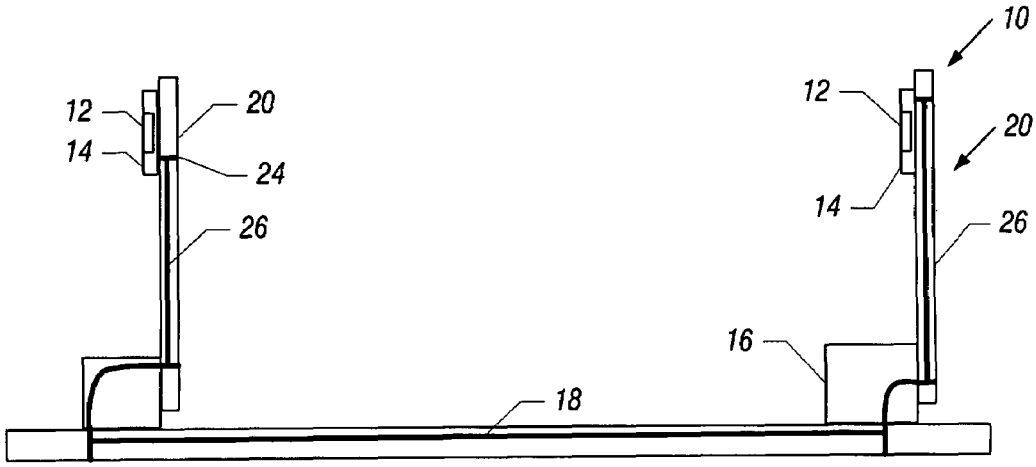
FIG. 1 is cross-sectional depiction of an interface in accordance with one embodiment of the present invention.

Referring to FIG. 1, a high speed interface connector 16 for a shelf or modular chassis-based system 10 includes a high speed backplane 18 and multiple input/output (I/O) line cards 20 that can be inserted into the modular system. The backplane is a passive circuit board providing connectors for front board slots. Each of the line cards 20 may include a package 14 and an integrated circuit chip 12 in some embodiments. A package to board via 24 may couple to a line card trace 26. The line card trace 26 is coupled to the backplane 18 through the high speed connector 16.

The high speed interface connector 16 includes a gradual arc bending L-shaped grounding structure with a pin insert that reduces the return loss spikes and insertion loss dips due to the resonance, around 8 GHz in the frequency domain. The connector 16 may support differential signaling of 40 Gigabytes per second and higher with an equalization technique.

In some embodiments, the system 10 provides better performance on the high speed interface connection and, thus, improves signal quality. For some shorter backplanes, this technique may be used independently to eliminate the need for complex equalization. For longer, complex backplanes, the system 10 may be coupled with simpler equalization techniques to improve the signaling performance at lower cost in some embodiments.

The backplane or motherboard 18 includes the two backplane connectors 16, linking two line cards 20. It also includes the two chips 12, one of which may be a transmitter chip and the other may be a receiver chip.

Figure 2:
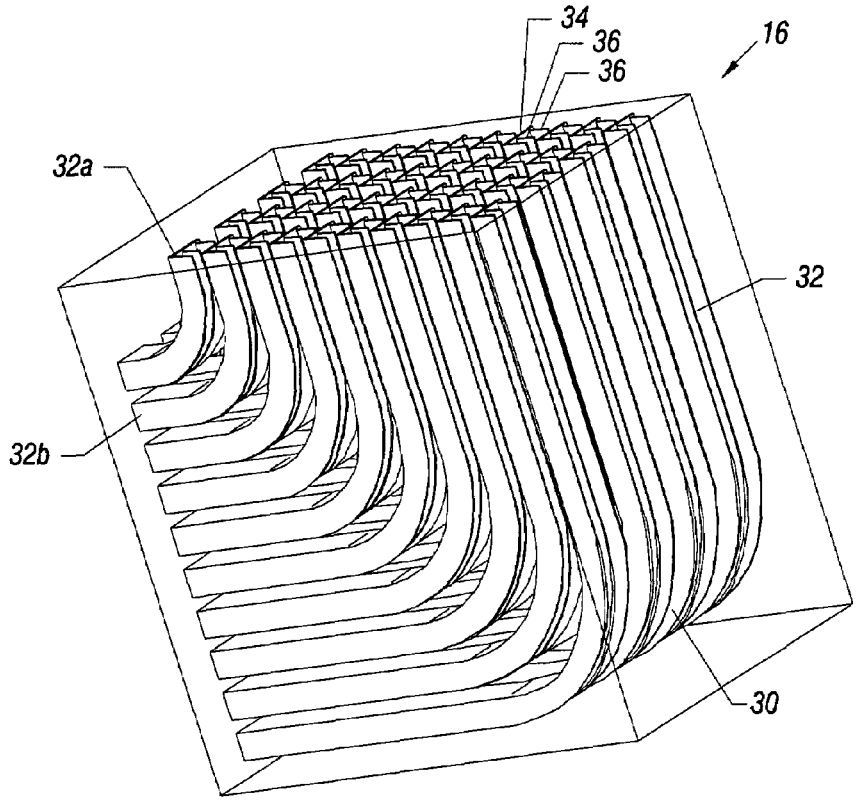
FIG. 2 is an enlarged, perspective view of the connector shown in FIG. 1 in accordance with one embodiment of the present invention.

Paired signal pins 36 and L-shaped grounding metal 34 may form the striplines included within the connector 16, as shown in FIG. 2. The connector 16 includes striplines 32 made up of pins 36 and metal 34 which have curved bends 30, rather than angled bends. Conventionally, obtuse angled bends between linear sections are utilized to make the connector turns from the line cards to the backplane. With the curved or arcuate bends 30, without the obtuse angled bends, performance may be improved. The curved bends 30 may provide an overall ninety degree bend with gradual increasing radii from one end of the connector to the other end as shown in FIG. 2. Thus, the striplines rest within one another such that a nested stripline 32*a* has a smaller radius of curvature than its nesting stripline 32*b*. Thus, because of the use of the gradual arc striplines 32, performance may be improved in some embodiments.

Each of the individual connectors 32 within the connector 16 may include paired signal pins 36 and L-shaped grounding metal 34. The L-shaped grounding metal 34 receives the signal pins 36. In some embodiments, the system 10 may be compatible with the Advanced Telecom Computing Architecture (ATCA) 3.0 (18 Mar. 2005) chassis developed by the PCI Industrial Computer Manufacturers Group (PICMG).

Figure 3:
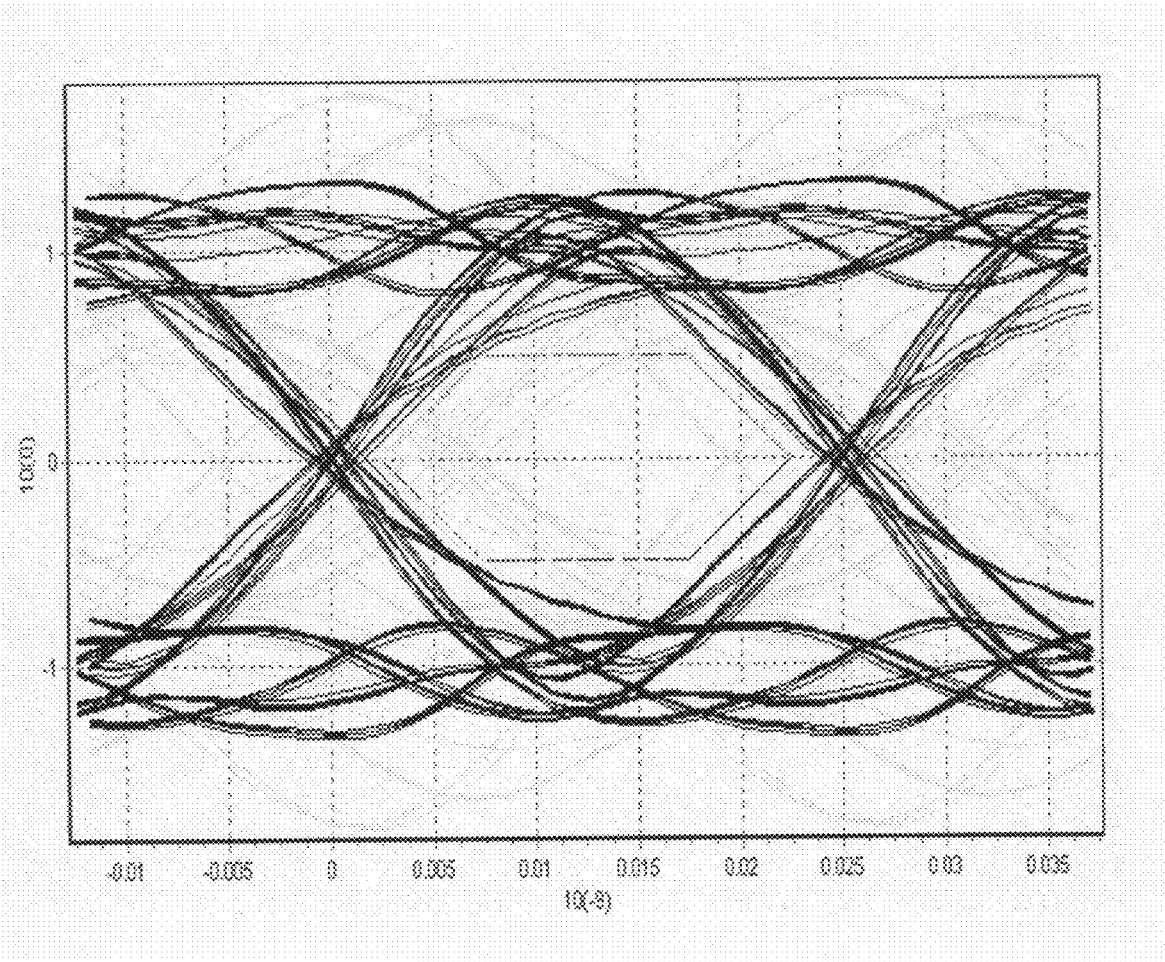
FIG. 3 is graph comparing time domain performance of a conventional connector versus some embodiments of the present invention.

With reference to FIG. 3, a graph illustrates a comparison of time domain performance at a data signaling rate of 40 gigabits per second (40 Gbps). The relatively darker lines illustrate the performance of a connector with gradual arc bending connector structure in accordance with some embodiments of the invention. The relatively lighter lines illustrate the performance of a conventional connector with the angled obtuse bending structure. As can be seen from FIG. 3, some embodiments of the invention may support up to 40 Gbps independently with more than 80% UI horizontal opening and more than 50% original input amplitude vertical opening, which may be compliant to various PCI-Express Generations eye pattern specifications.

References throughout this specification to "one embodiment" or "an embodiment" mean that a particular feature, structure, or characteristic described in connection with the embodiment is included in at least one implementation encompassed within the present invention. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A high speed connector, comprising:

a plurality of shielded differential signal striplines, each differential signal stripline including:

a pair of signal pins having a first end and a second end, and a pair of opposed planar surfaces separated by opposed edges; and an L-shaped ground metal proximate to the pair of signal pins from the first end to the second end, wherein the plurality of shielded differential signal striplines include only curved bends between the first end of the signal pins and the second end of the signal pins, such that one of said edges on each pin is radially outward of the other edge of each pin.

2. The high speed connector as recited in claim 1, wherein the connector can support data signal rates of at least forty gigabits per second.

3. The high speed connector as recited in claim 2, wherein the connector can provide at least 80% UI horizontal opening and more than 50% original input amplitude vertical opening.

4. The high speed connector as recited in claim 1, wherein the plurality of shielded differential striplines provide an overall ninety degree bend with only curved bends between the first end and the second of the signal pins.

5. The high speed connector as recited in claim 4, wherein the plurality of shielded differential signal striplines include nested striplines.

6. A modular chassis-system comprising:

a backplane;

a pair of line cards; and a pair of connectors to connect each line card to said backplane, said connectors including a stripline with only curved bends between respective ends of the connectors, each stripline including:

a pair of signal pins having a first end and a second end, and a pair of opposed planar surfaces separated by opposed edges, such that one of said edges on each pin is radially outward of the other edge of each pin; and an L-shaped ground metal proximate to the pair of signal pins from the first end to the second end.

7. The system of claim 6 wherein said signal pins are held within said L-shaped grounding metal.

8. The system of claim 6 wherein said stripline provides an overall ninety degree bend.

9. The system of claim 8 including a plurality of nested striplines with increasing radii.

* * * * *